US008992354B1

(12) United States Patent
Chieppo

(10) Patent No.: US 8,992,354 B1
(45) Date of Patent: Mar. 31, 2015

(54) KINETIC ENERGY ENHANCED ARROW APPARATUS AND METHOD

(71) Applicant: Douglas Jason Chieppo, Bardstown, KY (US)

(72) Inventor: Douglas Jason Chieppo, Bardstown, KY (US)

( * ) Notice: Subject to any disclaimer, the term of this patent is extended or adjusted under 35 U.S.C. 154(b) by 0 days.

(21) Appl. No.: 13/933,862

(22) Filed: Jul. 2, 2013

(51) Int. Cl.
*F42B 6/04* (2006.01)

(52) U.S. Cl.
CPC ..... *F42B 6/04* (2013.01)
USPC ..... 473/578

(58) Field of Classification Search
USPC ..... 473/578, 585, 586
See application file for complete search history.

(56) References Cited

U.S. PATENT DOCUMENTS

| | | | | |
|---|---|---|---|---|
| 1,669,118 | A | 5/1928 | Betts | |
| 2,940,759 | A | 6/1960 | West | |
| 3,036,396 | A | 5/1962 | Swails | |
| 3,168,313 | A | 2/1965 | Lint | |
| 4,268,038 | A | 5/1981 | Wierenga | |
| 4,900,038 | A * | 2/1990 | Czetto et al. | 473/570 |
| 4,951,952 | A | 8/1990 | Saddler | |
| 5,118,117 | A * | 6/1992 | Denen | 473/585 |
| 5,269,535 | A | 12/1993 | Gagné | |
| 5,294,131 | A | 3/1994 | Manske | |
| 6,375,586 | B1 | 4/2002 | Cousins et al. | |
| 6,450,905 | B1 | 9/2002 | Edlund | |
| 6,558,280 | B1 * | 5/2003 | Kuhn | 473/578 |
| 8,043,176 | B2 | 10/2011 | Byrne | |
| 8,241,157 | B2 * | 8/2012 | Russell et al. | 473/578 |
| 2002/0091023 | A1 | 7/2002 | Porter | |
| 2006/0154757 | A1 | 7/2006 | Sullivan et al. | |
| 2006/0160642 | A1 | 7/2006 | Sullivan et al. | |
| 2012/0146770 | A1 | 6/2012 | Brannen et al. | |

* cited by examiner

*Primary Examiner* — John Ricci
(74) *Attorney, Agent, or Firm* — Gold & Rizvi, P.A.; Glenn E. Gold

(57) ABSTRACT

A kinetic energy enhancing penetrator assembly for use with an archery arrow comprises a weighted arrow insert and a resilient member. The weighted arrow insert includes a semi-cylindrical body and a base extending from the body for releasable engagement with a nock of the arrow. The weighted arrow insert additionally includes a tapered head for engagement with the resilient member. The weighted arrow insert includes a feature enabling passage of air thereby reducing compression of air entrapped within a bore of an arrow shaft and any resulting resistance. The resilient member includes a coil spring affixed to a rear end of the insert for buffering impact of the weighted arrow insert against an arrowhead of the arrow. In use, the penetrator assembly within an arrow applies a secondary burst of kinetic energy upon the arrowhead upon impact with a target.

19 Claims, 9 Drawing Sheets

KINETIC ENERGY ENHANCED ARROW APPARATUS AND METHOD

FIELD OF THE INVENTION

The present invention relates to a kinetic energy enhanced arrow and method of enhancing the kinetic energy imparted by an archer's arrow or bolt to tissue, and more particularly, a kinetic energy enhanced arrow having a weighted insert movably mounted within the arrow and releasable upon engagement with tissue to impart additional kinetic energy to the arrowhead of the arrow.

BACKGROUND OF THE INVENTION

During hunting with archery equipment, it is desirable to have the arrow pass completely through the animal to ensure a clean kill and increase the possibility of a larger blood trail. Often, older manufactured bows lack the power to impart sufficient energy to the arrow, either through design or age, resulting in insufficient penetration of tissue to ensure a complete pass through. This is especially true if the arrow impacts bone structure such as ribs or shoulder bone.

Many archers must use light-weight bows due to shoulder injuries. Additionally, youth or weaker archers use lighter weight bows, as they do not have the strength to pull back heavy weight bows.

Some modern bows utilize cams to increase the energy imparted to the arrow while keeping the pull or draw weight reasonable for injured or weak archers. Alternatively, light weight arrows, such as carbon arrows, are available and allow for increased arrow speed from light weight bows to provide increased energy upon impact with tissue.

However, modern cam assisted bows, carbon arrows and other high tech equipment is often very expensive and out of reach of many archers.

Accordingly, there exists a need in the art for an apparatus and method of increasing the kinetic energy of an arrow upon impact with tissue.

SUMMARY OF THE INVENTION

The present invention overcomes the deficiencies of the known art and the problems that remain unsolved by providing a method and apparatus for enhancing the kinetic energy imparted by an archery arrow or bolt to tissue.

In accordance with one embodiment of the present invention, the invention consists of a penetrator assembly for use with an archery arrow or bolt having a tubular shaft comprising:

a weighted arrow insert having a body portion and a base extending rearwardly from the body portion, wherein a diameter of the body portion is substantially equal to an interior diameter of an arrow shaft through bore extending through the tubular shaft; and a resilient member.

In a second aspect of the invention, the body portion further comprises a feature enabling passage of air from a front end of the weighted arrow insert past a rear end of the weighted arrow insert to reduce any compression of air entrapped within the arrow shaft through bore.

In another aspect of the invention, the body portion is semi-cylindrical and includes at least one flat side.

In another aspect of the invention, the body portion has first and second arcuate sides and first and second flat sides.

In yet another aspect of the invention, the weighted arrow insert has a tapered head extending forwardly from the body portion.

In yet another aspect of the invention, the tapered head has a conical shape.

In yet another aspect of the invention, the tapered head has a flat impacting tip.

In yet another aspect of the invention, the tapered head has at least one flat side.

In yet another aspect of the invention, the resilient member is a spring.

In yet another aspect of the invention, the spring is a coil spring.

Introducing another embodiment of the present invention, the invention consists of a kinetic energy enhanced arrow comprising:

a tubular shaft having a through bore extending between a front shaft end and a rear shaft end;

an arrowhead affixed to the tubular shaft front end;

a nock affixed to the tubular shaft rear end; and a weighted arrow insert slideably assembled within the through bore and releasably attached to the nock.

In another aspect of the invention, the nock defines a bore and the weighted arrow insert includes a base releasably positioned in the bore of the nock.

In yet another aspect of the invention, the weighted arrow insert has a semi-cylindrical body.

In yet another aspect of the invention, the weighted arrow insert has a tapered head.

In yet another aspect of the invention, the invention further comprises a resilient member positioned within the through bore forward of the weighted arrow insert.

In yet another aspect of the invention, the invention further comprises an insert positioned within the front end of the tubular shaft and affixed to the arrowhead.

In yet another aspect of the invention, the resilient member is affixed to the insert.

In yet another aspect of the invention, the resilient member is a coil spring.

Introducing another embodiment of the invention, a method of imparting kinetic energy to an arrow comprising steps of:

obtaining an arrow, comprising:

a tubular shaft having a through bore extending between a front shaft end and a rear shaft end, an arrowhead affixed to the tubular shaft front end, and a nock affixed to the tubular shaft rear end;

providing a weighted arrow insert having a body and a base extending rearwardly from the body;

releasably engaging the base of the weighted arrow insert with the nock;

inserting the weighted arrow insert within the through bore at a location between the nock and the arrowhead;

releasing the weighted arrow insert from the nock by advancing the weighted arrow insert from the nock;

propelling the weighted arrow insert through the tubular shaft; and impacting an element located proximate the front end of the tubular shaft with the weighted arrow insert.

In another aspect, the method further comprises providing a resilient member positioned within the tubular shaft and impacting the resilient member with the weighted arrow insert.

In yet another aspect, the method further comprises compressing the resilient member with the weighted arrow insert to further impact the front end of the tubular shaft.

These and other features, aspects, and advantages of the invention will be further understood and appreciated by those skilled in the art by reference to the following written specification, claims and appended drawings.

BRIEF DESCRIPTION OF THE DRAWINGS

The presented embodiments of the invention will hereinafter be described in conjunction with the appended drawings provided to illustrate and not limit the invention, in which.

Like reference numerals refer to like parts throughout the several views of the drawings.

DETAILED DESCRIPTION OF THE INVENTION

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relative to the embodiments disclosed herein are not to be considered as limiting, unless the claims expressly state otherwise.

Figure 1:
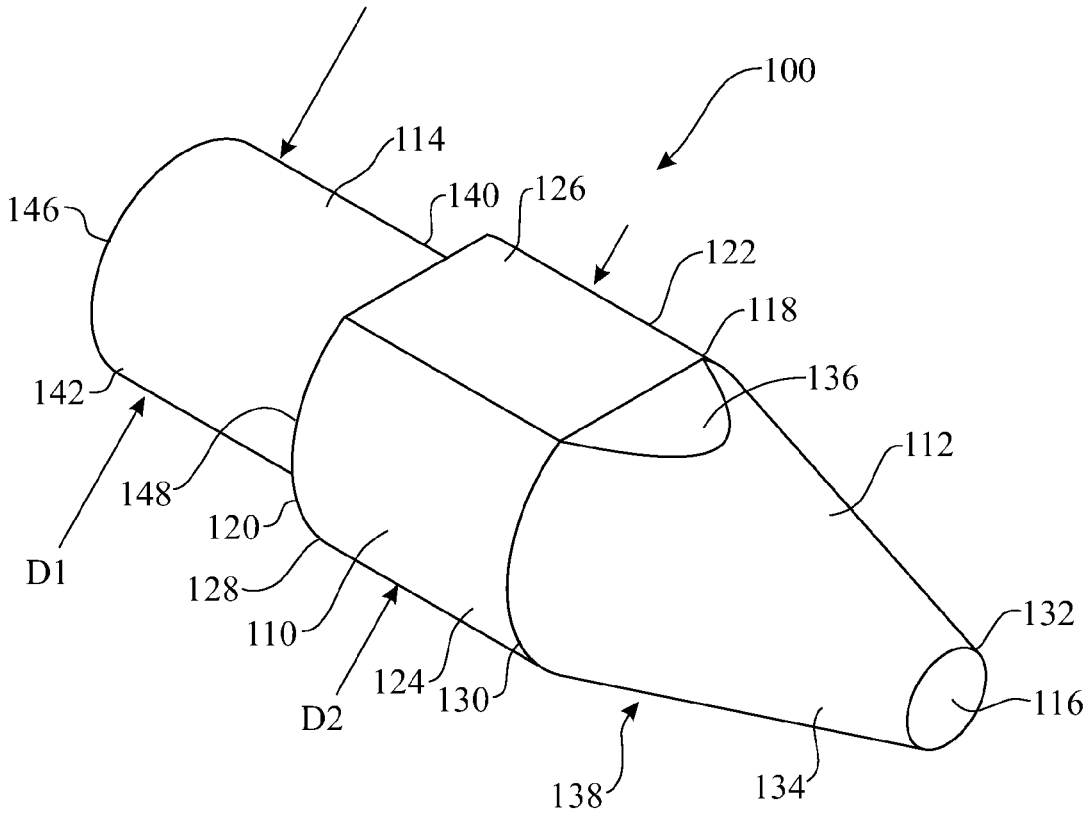
FIG. 1 presents an isometric view of an exemplary weighted arrow insert.
Figure 2:
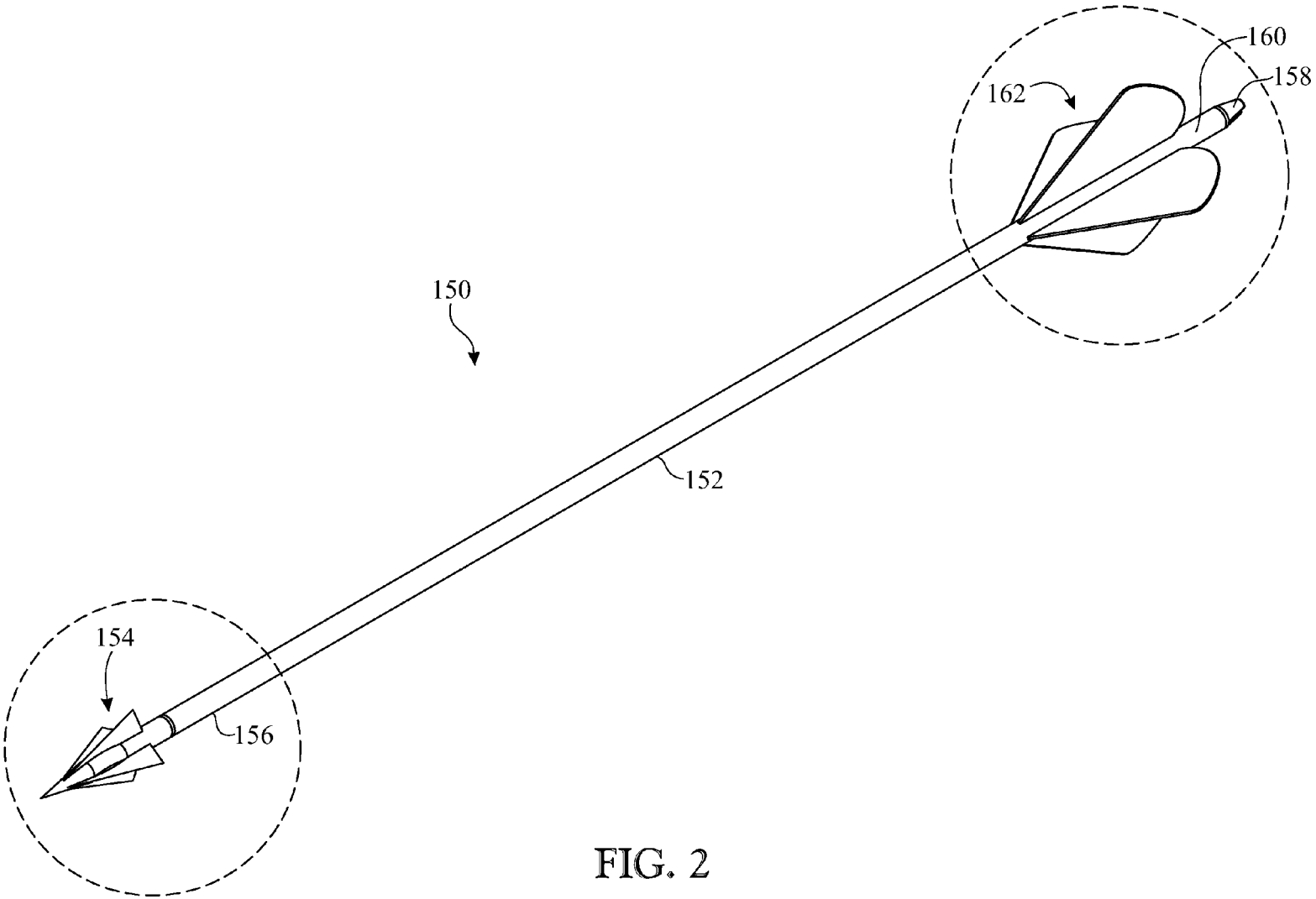
FIG. 2 presents an isometric view of an exemplary kinetic energy enhanced arrow.

A weighted arrow insert 100 is presented in FIGS. 1, 3 and 5-8 for use in a kinetic energy enhanced arrow 150 (FIG. 2). Referring initially to FIG. 1, the weighted arrow insert 100 generally includes a semi-cylindrical collar 110, a tapered head 112 and a base 114 extending rearwardly from collar 110. The tapered head 112 terminates at a flat tip 116. The flat tip 116 can be described as being planar. The plane defined by the flat tip 116 is preferably perpendicular to a longitudinal axis of the weighted arrow insert 100. The collar 110 includes a front end 118, a rear end 120, a first arcuate outer surface 122 and a second arcuate outer surface 124. An outside diameter of the collar 110 between the arcuate outer surfaces 122, 124 is substantially equal to an interior diameter of a through bore 202 (see FIG. 5) of an arrow shaft 152. A first flat outer surface 126 and a second flat outer surface 128 are formed between the first and second arcuate outer surfaces 122 and 124 such that the diameter of the collar 110 between the flat outer surfaces 126, 128 is less than the outside diameter of the collar 110 between the arcuate outer surfaces 122, 124 so as to provide a feature on the collar 110 enabling passage of air flow along the feature and around and past the collar 110 and from a front end and past a rear end of the weighted arrow insert 100 as the weighted arrow insert 100 travels through the arrow 150 in a manner described in more detail herein below. It will be readily understood that this feature will reduce any compression of air entrapped within the arrow shaft through bore caused by the travel of the weighted arrow insert 100 therein.

The tapered head 112 has a rear end 130 and a front end 132. The rear end 130 of the tapered head 112 extends from the front end 118 of the collar 110 while the front end 132 of the tapered head 112 terminates at the flat tip 116. The tapered head 112 has a conical outer surface 134 having a first flat portion 136 and a second flat portion 138 formed at the rear end 130. The first and second flat portions 136 and 138 formed on the tapered head 112 are preferably in longitudinal alignment with the first and second flat outer surfaces 126 and 128 formed on the collar 110 and assist in the flow of air on and over the weighted arrow insert 100.

The base 114 is cylindrical in shape, extending between a front end 140 and a rear end 142. The front end 140 extends from the rear end 120 of the collar 110 and the rear end 142 of the base 114 terminates at a flat rear face 146. As shown, diameter D1 of the base 114 is less than the diameter D2 of the collar 110. This results in a rear face 148 on the rear end 120 of the collar 110, which allows the weighted arrow insert 100 to seat within the arrow 150 in a manner described in more detail herein below. The diameter D2 of the collar 110 is generally proximate a diameter of an interior of the arrow shaft through bore 202 (FIG. 6) of the arrow tubular shaft 152.

The weighted arrow insert 100 may be formed from a variety of materials, such as, for example, ceramics, polymers or metallic materials. The weighted arrow insert 100 may be formed from separate structures including the collar 110, the tapered head 112 and the base 114 or may be formed as a monolithic structure. When formed as a monolithic structure from relatively heavy metallic material such as, for example, stainless steel, tungsten alloys, and the like, the weighted arrow insert 100 may be formed on a lathe to precisely control shape, dimensions, and balance.

Additionally, the various components of weighted arrow insert 100 may be treated or coated with a variety of substances to enhance performance within the arrow 150. For example, the collar 110 may be treated or coated with a friction reducing substance such as, for example, graphite, TEFLON™, etc. to facilitate passage through the arrow 150 while the base 114 may be treated or textured to increase friction within a nock bore 182 (FIG. 3) of the nock 158 (FIG. 2) of the arrow 150 for reasons described hereinbelow.

Referring now to FIG. 2, the arrow 150 generally includes an elongate hollow or tubular shaft 152, a tissue piercing arrowhead 154 affixed to a front end 156 of the tubular shaft 152 and a nock 158 affixed to a rear end 160 of the tubular shaft 152. A fletching assembly 162 is also affixed to the rear end 160 of the tubular shaft 152 to guide the arrow 150 during flight. The tubular shaft 152 can be formed from a variety of materials, including but not limited to aluminum or aluminum alloys, carbon or carbon composites, and the like.

Figure 3:
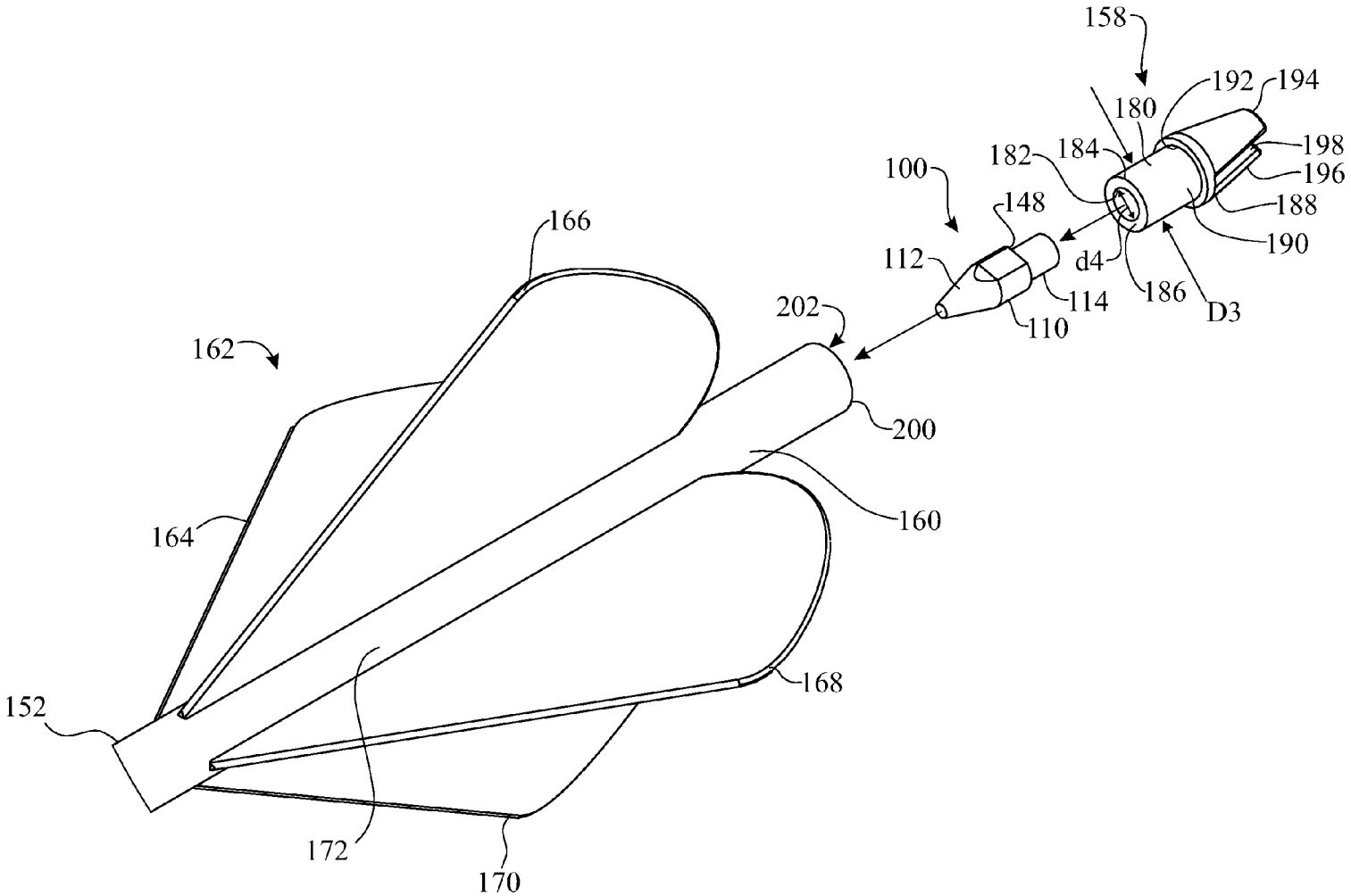
FIG. 3 presents an enlarged exploded isometric view of a rear section of the exemplary arrow originally introduced in FIG. 2, showing an enlarged exploded view of an arrow fletching and nock and illustrating placement of the weighted arrow insert through a rear section of the arrow shaft.

As best shown in FIG. 3, the fletching assembly 162 includes four feathers or vanes 164, 166, 168 and 170 longitudinally affixed to an outer surface 172 of tubular shaft 152. In addition to transferring energy received from a bowstring to the arrow 150, the nock 158 is provided to releasably retain the weighted arrow insert 100 within the rear end 160 of tubular shaft 152 until the arrow 150 engages with a target. Although the exemplary embodiment illustrates the fletching assembly 162 having four feathers or vanes 164, 166, 168 and 170, it is understood that the fletching assembly 162 can include any suitable number of feathers or vanes 164, 166, 168 and 170.

The nock 158 includes a hollow cylindrical body 180 defining a bore 182 for receipt of the base 114 of the weighted arrow insert 100. The cylindrical body 180 includes a front end 184 terminating at a front end face 186. The hollow cylindrical body 180 has an external diameter of D3 while the bore 182 of the cylindrical body 180 had an internal diameter of d4 sized to receive the base 114 (having a diameter of D1) in a friction fit fashion. A tapered rear body 188 extends from a rear end 190 of the cylindrical body 180 and includes a rear body front face 192 and spaced apart fingers 194 and 196 extending rearwardly from the rear body front face 192. The fingers 194 and 196 define a gap or slot 198 for receipt of a bowstring (not shown).

To assemble the arrow 150, initially, the weighted arrow insert 100 is removably assembled to the nock 158 by inserting the base 114 of the weighted arrow insert 100 into the bore 182 of the hollow cylindrical body 180 of the nock 158 such that the collar flat rear end face 148 of the collar 110 of the weighted arrow insert 100 is flush with the front end face 186 of the cylindrical body 180 of the nock 158. The weighted arrow insert 100 is thus releasably retained by the nock 158 until dislodged by impact with a target 300 (FIGS. 6-9). The combined weighted arrow insert 100 and nock 158 are then assembled to the arrow 150 by applying a glue or other adhesive to the cylindrical body 180 and inserting the weighted arrow insert 100 and the cylindrical body 180 of the nock 158 into the rear end 160 of the arrow 150.

Specifically, the rear end 160 of the arrow 150 includes a rear end face 200 and the tubular shaft 152 of the arrow 150 defines a through bore 202. The cylindrical body 180 of the nock 158 is inserted into the through bore 202 until the front face 192 of the nock 158 is flush with the rear end face 200 of the tubular shaft 152. It should be noted that, while the nock 158 is retained within the through bore 202 by a glue or adhesive, in some instances, such as, for example, when the orientation of the arrowhead 154 or the fletching assembly 162 need be precisely oriented respective to a bow handle or string (not shown), the nock 158 may be received within through bore 202 of the tubular shaft 152 in friction fit fashion.

Figure 4:
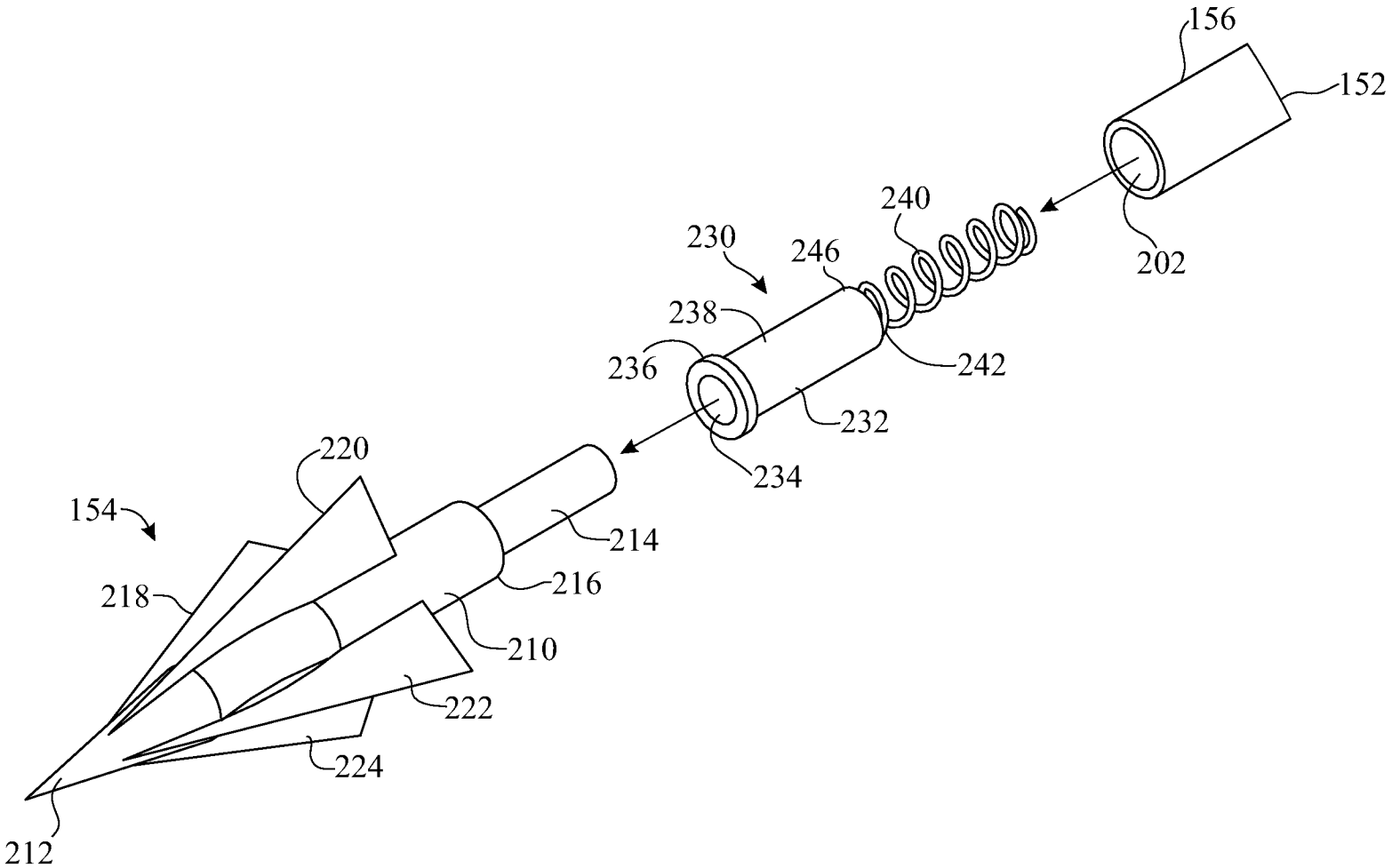
FIG. 4 presents and enlarged exploded isometric view of a front section of the exemplary arrow originally introduced in FIG. 2, showing an enlarged exploded view of an arrowhead, an arrowhead insert, and a front section of the shaft.

Turning now to FIG. 4, the arrowhead 154 generally includes an arrowhead body 210 terminating in a forward tissue-penetrating tip 212 and a rearwardly extending shaft 214 extending from a rear end 216 of the arrowhead body 210 for attachment to the tubular shaft 152. The arrowhead 154 additionally includes a plurality of cutting blades such as, for example, cutting blades 218, 220, 222, 224.

An insert 230 is provided for assembling the arrowhead 154 to the tubular shaft 152, wherein the insert 230 includes a hollow body 232 defining an internal bore 234. The internal bore 234 may be smooth to receive the shaft 214 of the arrowhead 154 and be secured thereto by any suitable joining method, including gluing, welding, and the like. Alternatively, the shaft 214 of the arrowhead 154 may be threadably assembled to a threaded shaft 214 of the arrowhead 154. The insert 230 additionally includes a flange 236 at a front end 238 of the hollow body 232. The flange 236 seats against the front end 156 of the tubular shaft 152 when the hollow body 232 is inserted into the through bore 202 of the tubular shaft 152.

In order to absorb and/or reduce the impact of the weighted arrow insert 100 against the insert 230, a resilient member or spring 240 is provided within the through bore 202 in the front end 156 of the tubular shaft 152. The resilient member may be provided in a form of a coil spring 240 or may include other resilient structures such as, for example, leaf springs, foam or other compressible materials such as polymers, and the like. These are chosen to be sufficient to absorb an impact asserted from the weighted arrow insert 100 against the insert 230 and preventing dislodgement thereof from the tubular shaft 152 upon impact with a target 300. Preferably, a forward end 242 of the spring 240 is affixed to a rear end 246 of the hollow body 232 of the insert 230. The spring 240 additionally acts as a vibration dampener to stabilize the arrow 150 during flight.

It should be noted that, while the weighted arrow insert 100 and the spring 240 are disclosed as supplied with, and assembled to, the arrow 150, the weighted arrow insert 100 and the spring 240 may be provided together, separate from the arrow, to form a "penetrator" assembly 250 for use with a variety of arrows.

Referring now to FIGS. 1 and 5-9, the use of the penetrator assembly 250 within the arrow 150 to increase or provided multiple kinetic energy impulses through arrowhead 154 upon impact with a target will now be described.

Figure 5:
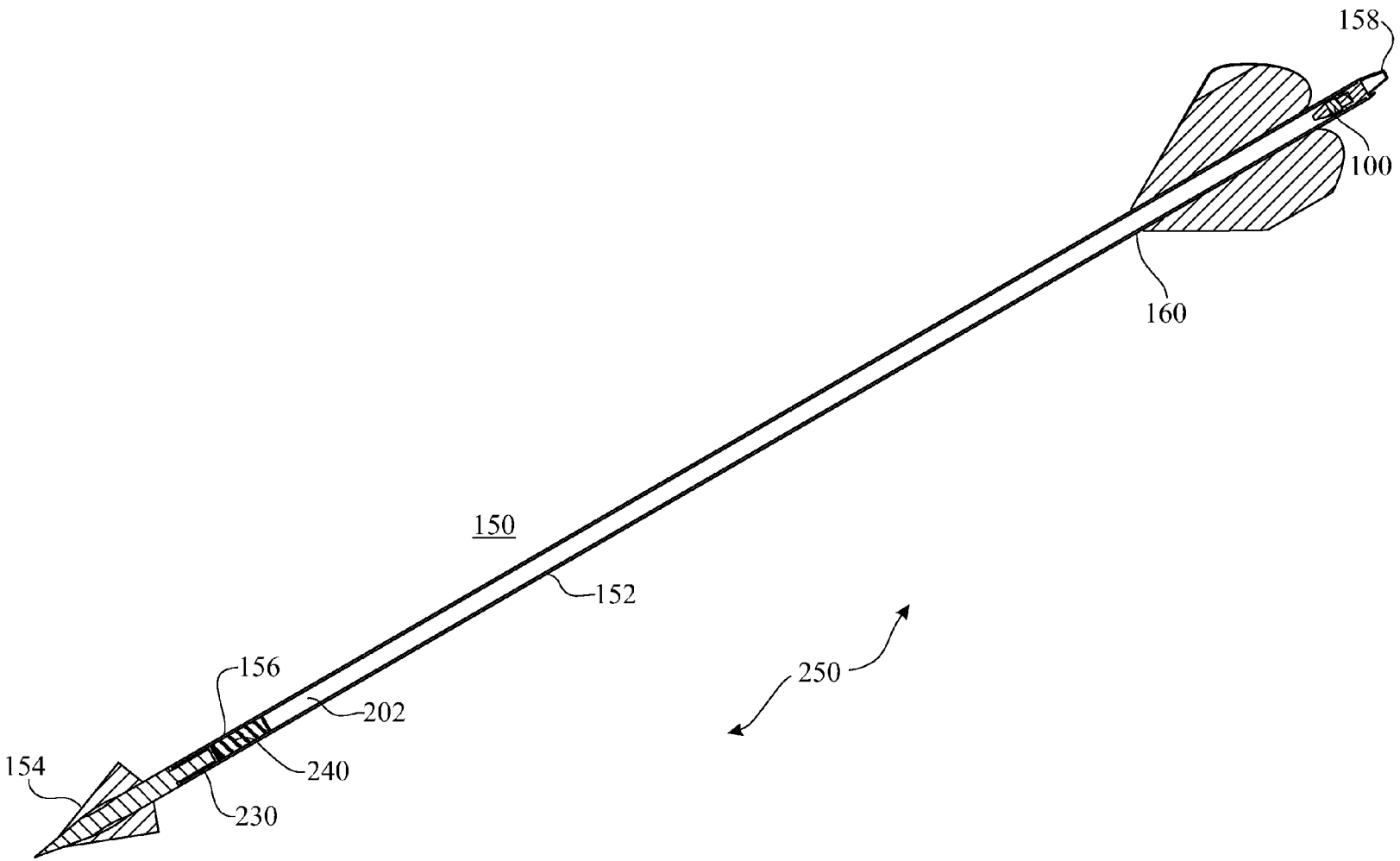
FIG. 5 presents a longitudinally sectioned view of the exemplary arrow originally illustrated in FIG. 2, illustrating placement of the weighted arrow insert within the arrow.

Referring initially to FIG. 5, the arrow 150 is fully assembled including the penetrator assembly 250. The weighted arrow insert 100 is releasably retained within the through bore 202 at the rear end 160 of the tubular shaft 152 by the nock 158. The spring 240 is secured to the insert 230 within the through bore 202 at the front end 156 of the tubular shaft 152. With reference to FIGS. 1, 3 and 5, when an archer wishes to launch the arrow 150 towards a target, such as, for example, a game animal, the arrow 150 is positioned on a bow such that a bow string or cable (not shown) is positioned within the gap 198 created between the fingers 194 and 196 of the nock 158. The bowstring or cable is then drawn rearward and subsequently released, transferring the energy generated by deformation of the bow to the arrow 150 through the nock 158. This propels the arrow 150 forward at an initial velocity.

Figure 6:
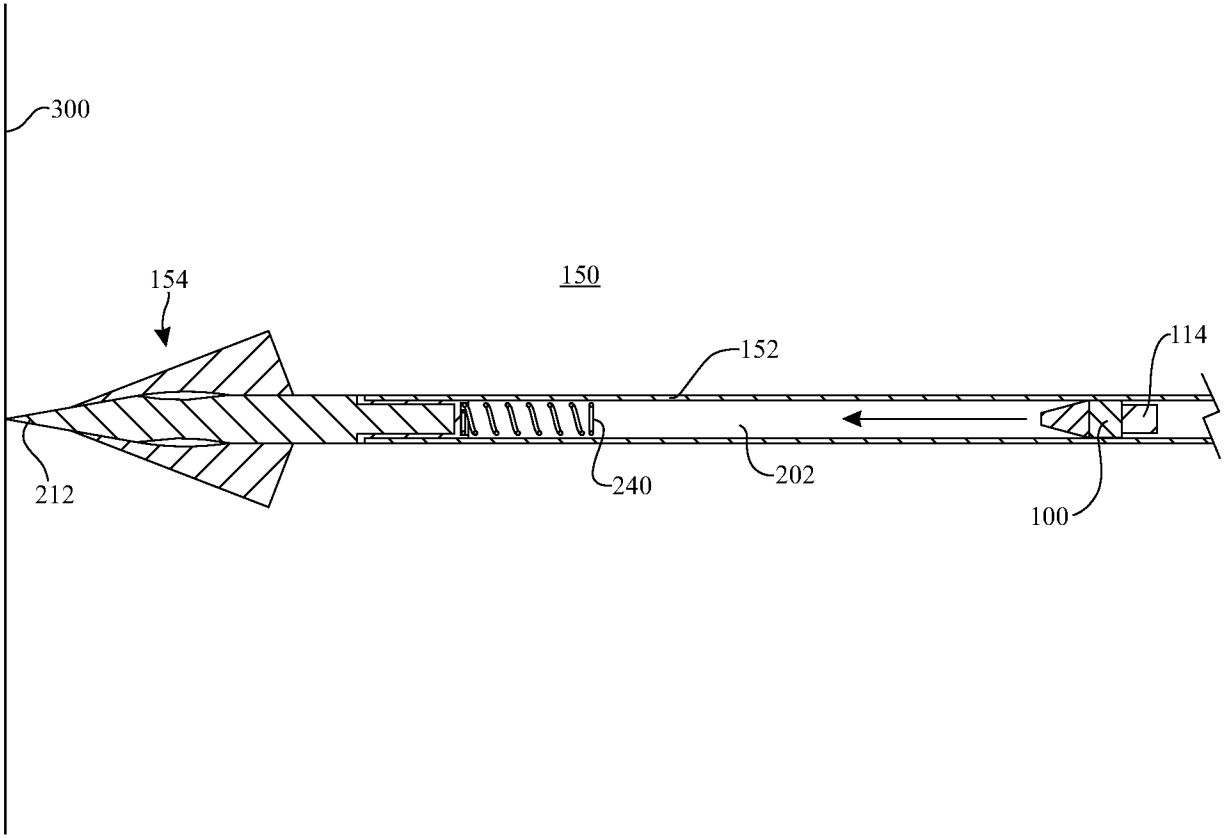
FIG. 6 presents a longitudinally sectioned view of the front section of the exemplary arrow originally introduced in FIG. 2, illustrating the arrow contacting a target and showing the weighted arrow insert traveling forward within the shaft towards the arrowhead.

Referring to FIG. 6, as the arrowhead 154, and more specifically the tissue penetrating tip 212, hits and engages a target surface 300, forward momentum of the arrow 150 is interrupted or slowed and the inertial energy of the weighted arrow insert 100 dislodges and releases the weighted arrow insert 100 from its frictional engagement with the nock 158. The inertial energy of the weighted arrow insert 100 causes the weighted arrow insert 100 to travel through the through bore 202 of the tubular shaft 152 of the arrow 150 at substantially the same velocity of arrow 150 just prior to engagement with the target 300. As noted hereinabove, the flat outer surfaces 126 and 128 on the collar 110 and the flat sections 136 and 138 of the tapered head 112 of the weighted arrow insert 100 allow for the passage of air over the weighted arrow insert 100 as the weighted arrow insert 100 travels forward through the shaft through bore 202 within the tubular shaft 152. This prevents compression of air within tubular shaft 152 ahead of the weighted arrow insert 100 which may slow travel of the weighted arrow insert 100 as the weighted arrow insert 100 passes through the tubular shaft 152, which would diminish the momentum of the weighted arrow insert 100.

Figure 7:
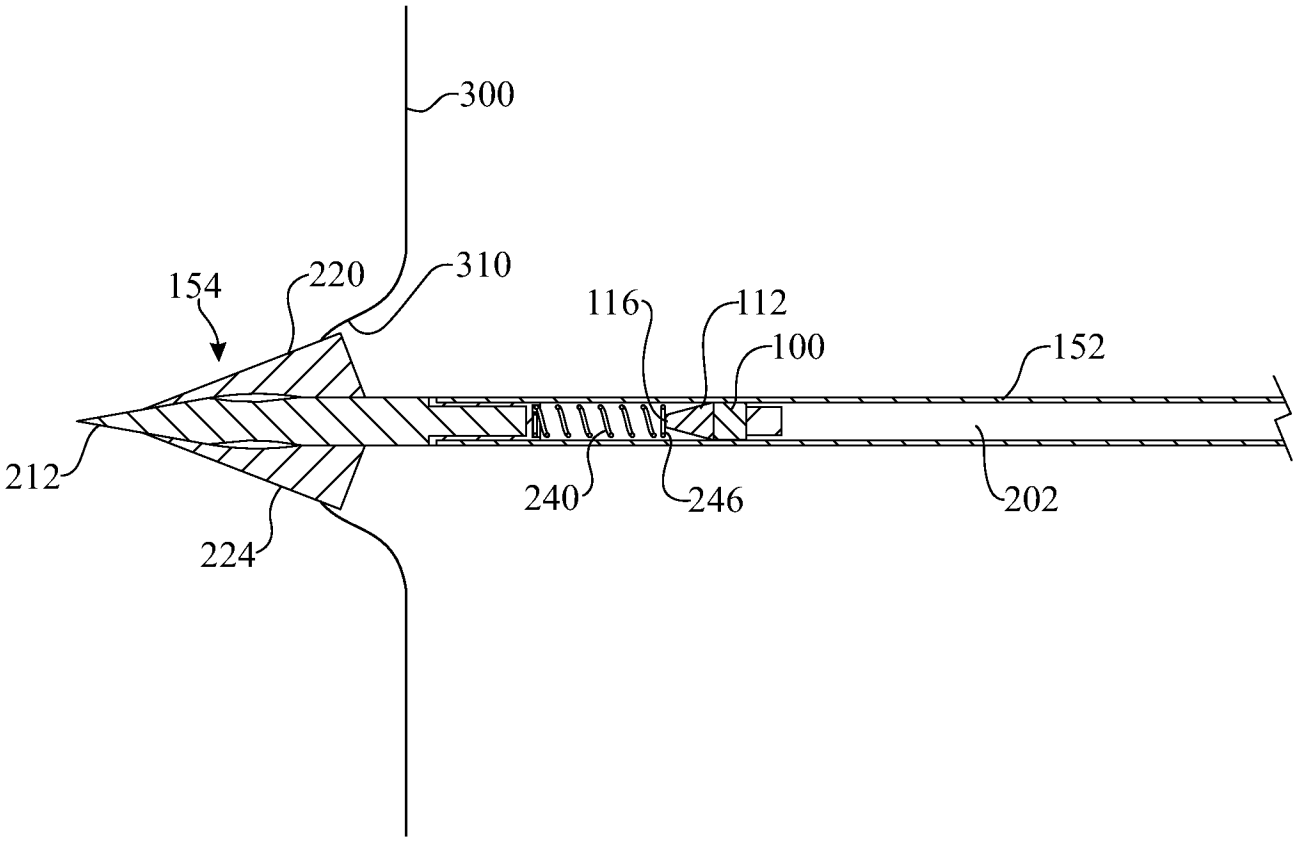
FIG. 7 presents a cross longitudinally sectioned view of the front section of the exemplary arrow originally introduced in FIG. 2, illustrating the arrow being further driven into the target and showing the weighted arrow insert striking a spring, delivering a first burst of kinetic energy.

As best shown in FIGS. 6 and 7, the tissue-penetrating tip 212 and respective blades 218, 220, 222 and 224 of the arrowhead 154 penetrate and create a cut 310 into the tissue 300. Function of the weighted arrow insert 100 within the arrow 150 is additionally described by a representative schematic diagram illustrated in FIG. 9. When the weighted arrow insert 100, specifically the tip 116 of the tapered head 112, initially engages with the rear end 246 of the spring 240, the weighted arrow insert 100 imparts a first burst of kinetic energy (KE), defined by the formula $KE=\frac{1}{2}mv^2$ (where "m" is the mass of weighted arrow insert 100 and "v" is the velocity at time of impact with the spring 240), to the arrowhead 154 to overcome its inertia. This first burst of kinetic energy (KE) drives the arrowhead 154 an initial depth 320 (FIG. 9) further into the tissue 300.

Figure 8:
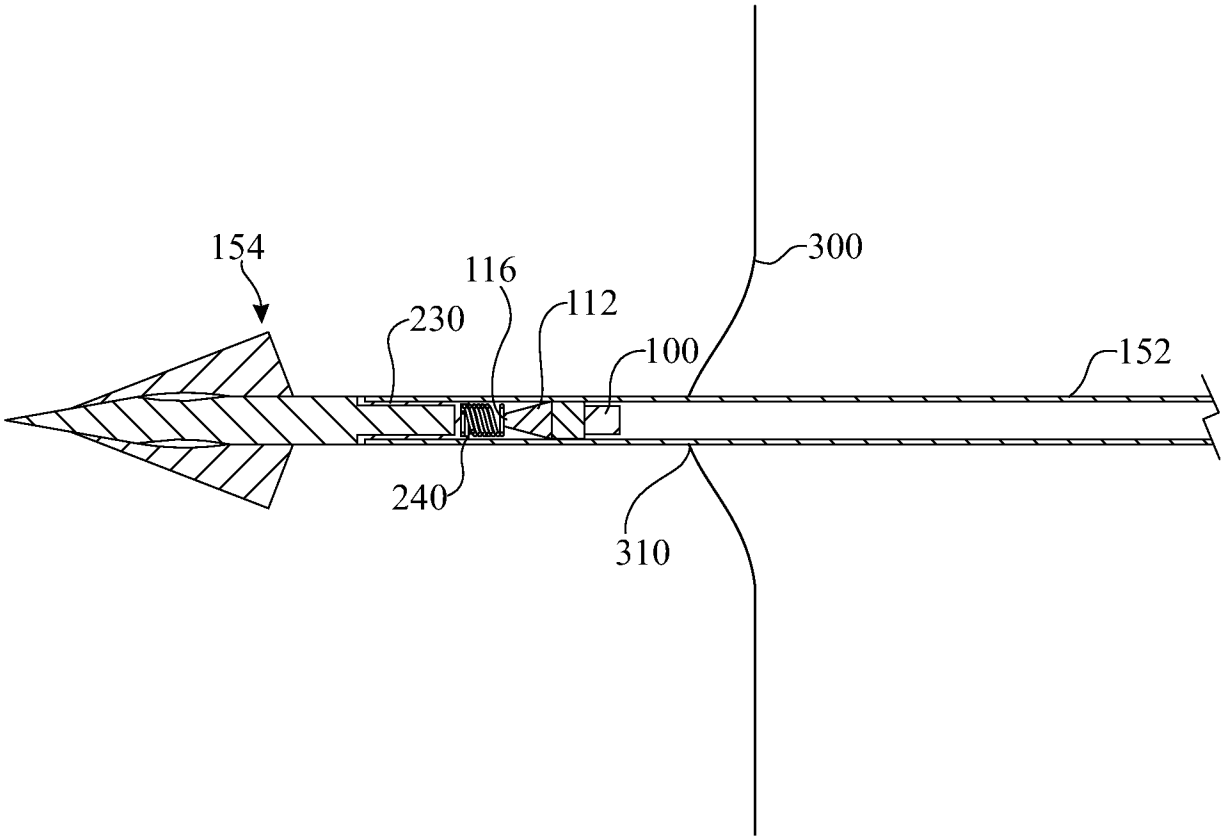
FIG. 8 presents a longitudinally sectioned view of the front section of the exemplary arrow originally introduced in FIG. 2, illustrating the weighted arrow insert compressing the spring, delivering a second burst of kinetic energy, driving the arrowhead even farther into the target.
Figure 9:
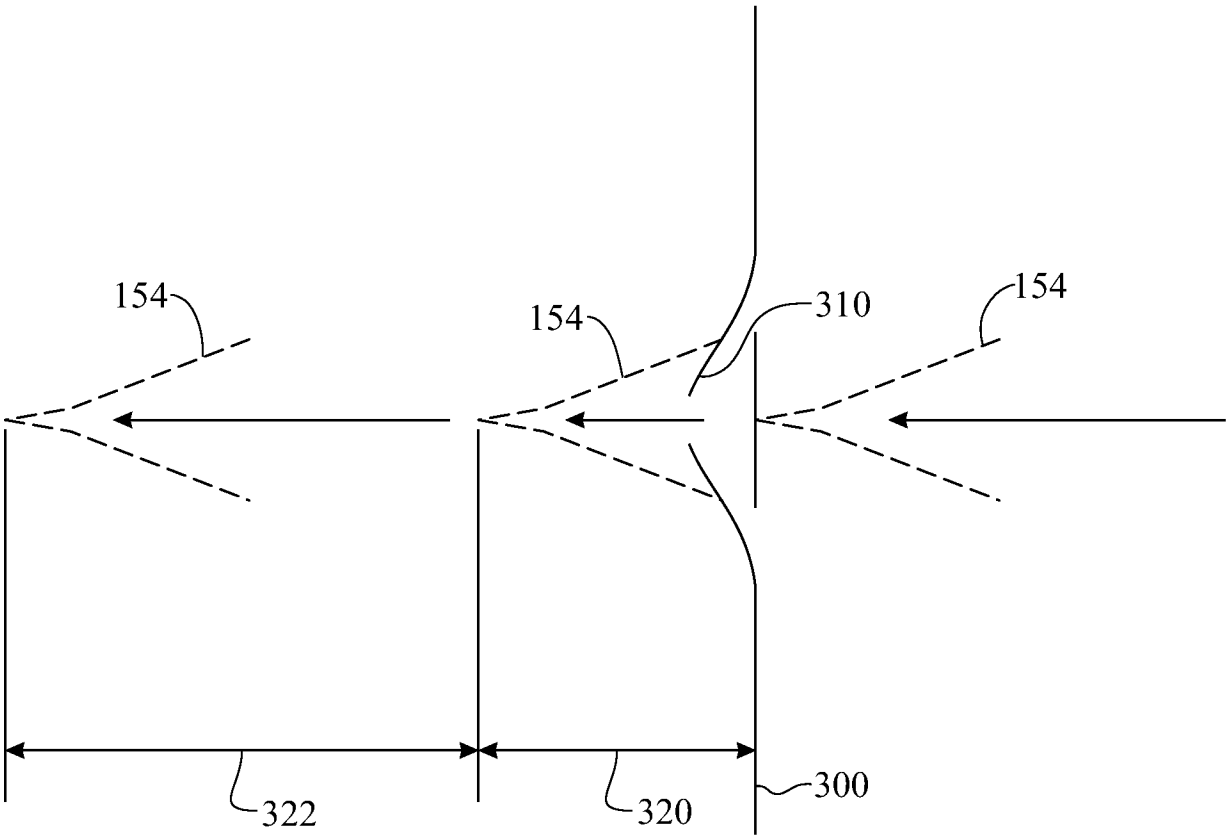
FIG. 9 presents a schematic illustration presenting exemplary distinct distances traveled by the launched arrow, originally introduced in FIG. 2, as the launched arrow contacts and penetrates the target, while receiving the two additional bursts of kinetic energy provided by the weighted arrow insert.

With reference to FIG. 8, upon full compression of the spring 240 by the weighted arrow insert 100, the weighted arrow insert 100 imparts a second burst of kinetic energy (KE) to the arrowhead 154 further driving the arrowhead 154 a subsequent depth 322 further into and through the cut 310 in the tissue 300. These first and second bursts of kinetic energy imparted to the arrowhead 154 by the penetrator assembly 250 help ensure a complete pass through of the arrowhead 154 through the target tissue 300. As noted hereinabove, the spring 240 buffers the insert 230 against the impact of the weighted arrow insert 100 to prevent the insert 230 and thus the arrowhead 154 from dislodging or breaking off from the tubular shaft 152 of the arrow 150.

While not specifically shown, a minor third burst of kinetic energy is imparted to the arrowhead 154 by expansion of the spring 240 back to its original uncompressed state. The forward momentum of the weighted arrow insert 100 acts as a base during expansion of the spring 240, driving the arrowhead 154 a further slight distance forward.

Although the weighted arrow insert 100 includes a series of flat sections 136, 138 it is understood that the weighted arrow insert 100 may include a through bore (not shown) providing the same function for passage of air therethrough to reduce any compression of air entrapped within the arrow shaft through bore 202.

The above-described embodiments are merely exemplary illustrations of implementations set forth for a clear understanding of the principles of the invention. Many variations, combinations, modifications or equivalents may be substituted for the elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A penetrator assembly for use with an archery arrow having a tubular shaft, the penetrator assembly comprising:

a weighted arrow insert having a body portion and a base extending rearwardly from said body portion, wherein a part of said body portion has a diameter less than an outside diameter of the body portion, being substantially equal to an interior diameter of an arrow shaft through bore extending through said tubular shaft, so as to provide a feature on said part of said body portion enabling passage of air along said feature from a front end of the weighted arrow insert past a rear end of the weighted arrow insert to reduce any compression of air entrapped within the arrow shaft through bore; and a resilient member.

2. The penetrator assembly as recited in claim 1, wherein said resilient member is a spring.

3. The penetrator assembly as recited in claim 1, wherein said resilient member is a coil spring.

4. A penetrator assembly for use with an archery arrow having a tubular shaft, the penetrator assembly comprising:

a weighted arrow insert having a body portion and a base extending rearwardly from said body portion, wherein a diameter of the body portion is substantially equal to an interior diameter of an arrow shaft through bore extending through said tubular shaft; and a resilient member;

wherein said body portion is semi-cylindrical and includes at least one flat side.

5. The penetrator assembly as recited in claim 4, said body portion further comprising first and second arcuate sides and first and second flat sides.

6. A penetrator assembly for use with an archery arrow having a tubular shaft, the penetrator assembly comprising:

a weighted arrow insert having a body portion, a base extending rearwardly from said body portion and a tapered head extending forwardly from said body portion, wherein a diameter of the body portion is substantially equal to an interior diameter of an arrow shaft through bore extending through said tubular shaft; and a resilient member.

7. The penetrator assembly as recited in claim 6, wherein said tapered head further comprises a planar impacting tip, wherein a plane defined by said planar impacting tip is perpendicular to a longitudinal axis of said weighted arrow insert.

8. A kinetic energy enhanced arrow comprising:

a tubular shaft having a through bore extending between a front shaft end and a rear shaft end;

an arrowhead affixed to said tubular shaft front end;

a nock comprising a forward portion inserted into said through bore at said tubular shaft rear end and being affixed to said tubular shaft rear end, and a rearward portion extending from said tubular shaft rear end and defining a slot for receipt of a bowstring; and a weighted arrow insert comprising a rear portion releasably attached to said forward portion of said nock, and a front portion extending from said rear portion forwardly of said forward portion of said nock, said weighted arrow insert being slideable within said through bore upon release from said nock.

9. The kinetic energy enhanced arrow as recited in claim 8, wherein:

said forward portion of said nock further comprising a bore; and said rear portion of said weighted arrow insert further comprising a base, wherein said base is releasably retained within said bore of said nock.

10. The kinetic energy enhanced arrow as recited in claim 8, wherein said weighted arrow insert is shaped comprising a semi-cylindrical body.

11. The kinetic energy enhanced arrow as recited in claim 8, wherein said weighted arrow insert further comprising a body portion and a tapered head extending forwardly from said body portion.

12. The kinetic energy enhanced arrow as recited in claim 8, further comprising a resilient member positioned within said through bore between said weighted arrow insert and said arrowhead.

13. The kinetic energy enhanced arrow as recited in claim 12, further comprising an insert positioned within said front end of said tubular shaft and affixed to said arrowhead.

14. The kinetic energy enhanced arrow as recited in claim 13, wherein said resilient member is affixed to said insert that is affixed to said arrowhead.

15. The kinetic energy enhanced arrow as recited in claim 12, wherein said resilient member is a coil spring.

16. The kinetic energy enhanced arrow as recited in claim 8, wherein said weighted arrow insert further comprising a portion having a diameter less than an outside diameter of said weighted arrow insert, being substantially equal to an interior diameter of the tubular shaft through bore, so as to provide a feature on said portion enabling passage of air along said feature from a front end of the weighted arrow insert past a rear end of the weighted arrow insert to reduce any compression of air entrapped within the tubular shaft through bore.

17. A method of enhancing kinetic energy imparted to an arrow upon engagement with a target, the method comprising steps of:

obtaining an arrow, comprising:

a tubular shaft having a through bore extending between a front shaft end and a rear shaft end, an arrowhead on said tubular shaft front end, and a nock on said tubular shaft rear end;

providing a weighted arrow insert having a body and a base extending rearwardly from said body;

removing said nock from said tubular shaft rear end;

releasably attaching said base of said weighted arrow insert to said removed nock;

inserting said weighted arrow insert releasably attached to said nock within said tubular shaft through bore at said tubular shaft rear end and affixing said nock to said tubular shaft rear end;

releasing said weighted arrow insert from the affixed nock by advancing said weighted arrow insert from the nock;

propelling said weighted arrow insert through the tubular shaft toward said arrowhead on said tubular shaft front end; and impacting an element located proximate said arrowhead on said front end of said tubular shaft with said weighted arrow insert.

18. The method as recited in claim 17, further comprising a step of dampening said impact between said weighted arrow insert and said element located proximate said arrowhead on said tubular shaft front end by including a resilient member positioned within said tubular shaft between said weighted arrow insert and said arrowhead.

19. The method as recited in claim 17, further comprising a step of reducing air resistance within said through bore of said arrow tubular shaft by enabling air to pass from a forward end of said weighted arrow insert a rear end of said weighted arrow insert along a feature provided by a portion of said weighted arrow insert having a diameter less than an outside diameter of said weighted arrow insert, said outside diameter of said weighted arrow insert being substantially equal to an interior diameter of the arrow tubular shaft through bore.

* * * * *